US006923097B2

(12) United States Patent
Takasaki

(10) Patent No.: US 6,923,097 B2
(45) Date of Patent: Aug. 2, 2005

(54) PLIERS FOR REMOVING SMALL SCREWS AND THE LIKE

(75) Inventor: Mitsuhiro Takasaki, Osaka (JP)

(73) Assignee: Kabushiki Kaisha Engineer, Osaka (JP)

( * ) Notice: Subject to any disclaimer, the term of this patent is extended or adjusted under 35 U.S.C. 154(b) by 108 days.

(21) Appl. No.: 10/401,021

(22) Filed: Mar. 28, 2003

(65) Prior Publication Data

US 2003/0233915 A1 Dec. 25, 2003

(30) Foreign Application Priority Data

Mar. 29, 2002 (JP) ..... 2002-095319

(51) Int. Cl.[7] ..... B25B 7/02
(52) U.S. Cl. ..... 81/418; 81/424.5
(58) Field of Search ..... 81/418, 424.5, 81/426.5

(56) References Cited

U.S. PATENT DOCUMENTS 4,730,524 A * 3/1988 Petersen ..... 81/367
4,989,479 A * 2/1991 Anderson et al. ..... 81/424.5
6,012,362 A * 1/2000 Wang ..... 81/368

FOREIGN PATENT DOCUMENTS

| | | |
|---|---|---|
| JP | 56-2383 | 1/1981 |
| JP | 59-93872 | 6/1984 |
| JP | 61-57156 | 12/1986 |
| JP | 4-28958 | 3/1992 |
| JP | 5-8054 | 3/1993 |
| JP | 8-18257 | 2/1996 |
| JP | 9-109048 | 4/1997 |
| JP | 2000-6052 | 1/2000 |

* cited by examiner

*Primary Examiner*—Derris H. Banks
*Assistant Examiner*—Jamila O Williams
(74) *Attorney, Agent, or Firm*—Crowell & Moring LLP

(57) ABSTRACT

Pliers for advantageously removing small screws are provided. The pliers have a pair of upper and lower arms which are pivotally supported by a shaft. Front end tips of the upper and lower arms are respectively provided with upper and lower recessed engagement parts between right and left edges, and the engagement parts vertically face each other. The upper and lower engagement parts are inclined in a manner such that they gradually become separated vertically from each other toward the rear when the jaws are closed. An inner bottom included in each of engagement parts is provided with plural projected and depressed streams extending in a back and forth direction.

6 Claims, 8 Drawing Sheets

Fig.1A
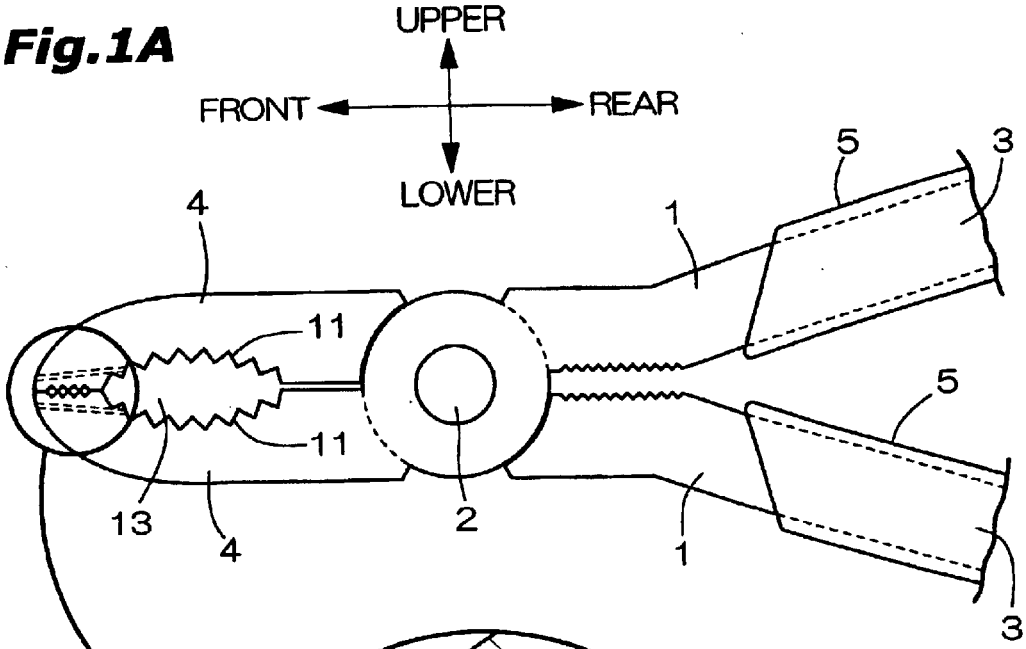
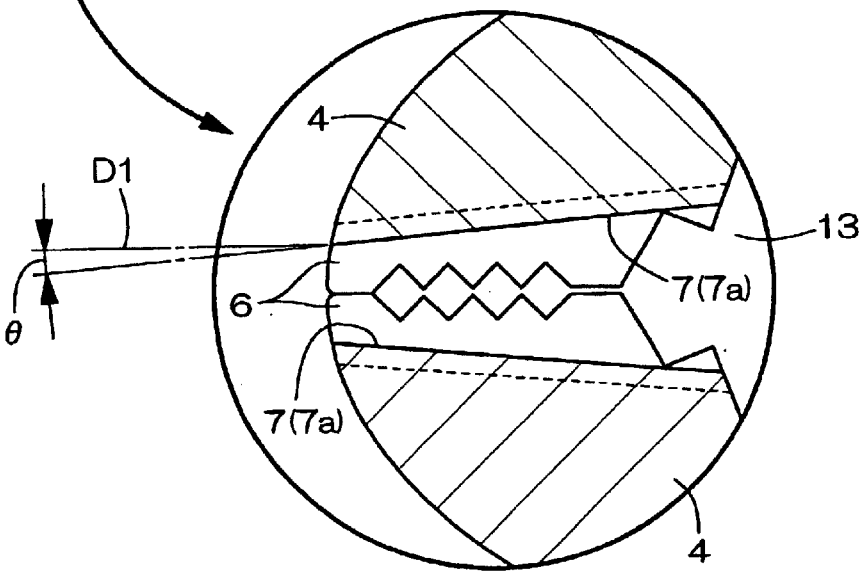
Fig.1B

Fig.3A
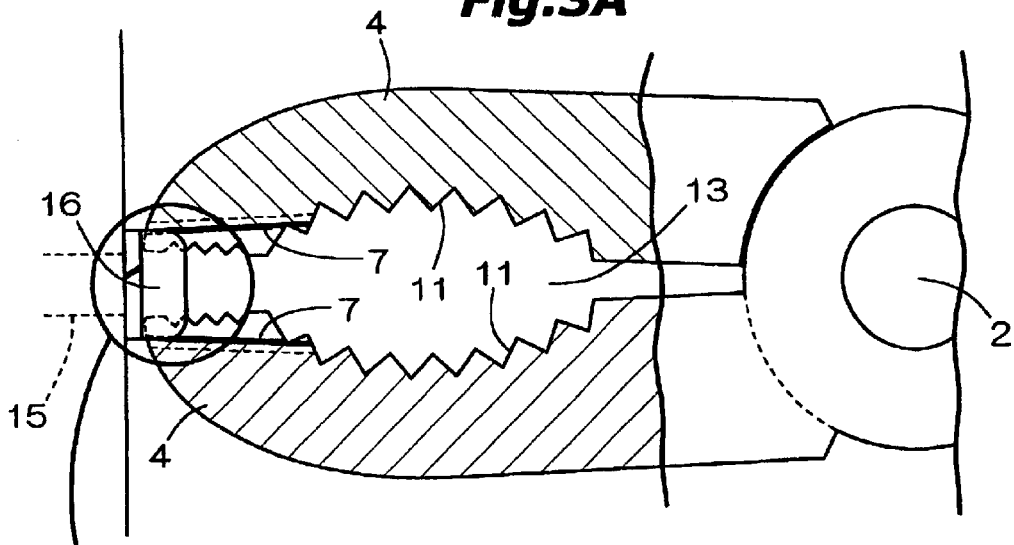
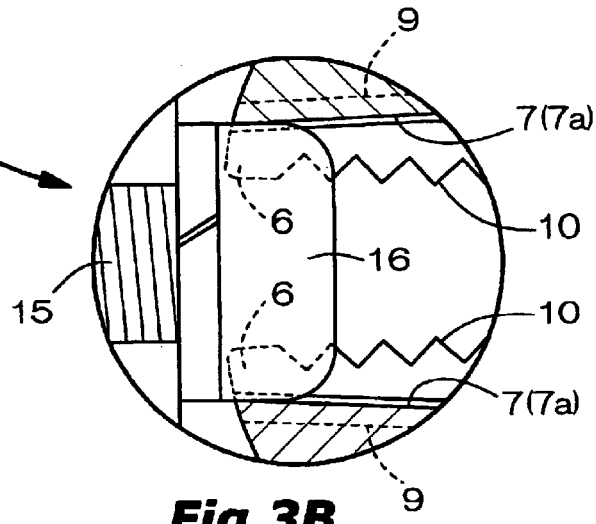
Fig.3B

COMPARATIVE EXAMPLE

COMPARATIVE EXAMPLE

PLIERS FOR REMOVING SMALL SCREWS AND THE LIKE

BACKGROUND OF THE INVENTION

This invention relates to pliers for removing small screws and the like.

Conventional pliers as disclosed in Japanese laid-open application publication No. 09-109048 comprise serrate jaw tips which are formed in a recessed shape. This structure can increase contact areas between a head of a screw and engaging surfaces of the pliers, thereby enhancing the engagement retaining force of the pliers. Consequently, this kind of pliers can exert a larger rotational operation force to the head of a screw than general types of pliers.

The engagement retaining force of the above pliers, however, is still insufficient for holding heads of screws, especially for holding rusted heads, heads stripped by long repeated usage, or screws having no engaging and handling planes for the purpose of tamper proofing, and more especially for small screws.

SUMMARY OF THE INVENTION

The present invention is directed to overcoming one or more of problems as set forth above. It is an object of the present invention to provide pliers which securely hold heads of screws, and make it possible for a user to easily remove even small screws.

In accordance with one aspect of the present invention, pliers comprise a pair of upper and lower arms that are pivotally supported by a shaft. In this structure, front end tips of jaws respectively included in the arms are provided with upper and lower recessed engagement parts between right and left edges, and engagement parts vertically face each other. Each of the upper and lower engagement parts makes a trapeziform shape that comprises an inner bottom, and right and left sidewalls which are inclined in a manner such that a space between said sidewalls becomes wider outward. Each of engagement parts has a predetermined length in a back and forth direction. The inner bottoms of the upper and lower engagement parts are inclined in a manner such that the engagement parts gradually become separated vertically from each other toward the rear when the jaws are closed. Further, the inner bottom of each of engagement parts is provided with plural projected and depressed streams extending in a back-and-forth direction.

BRIEF DESCRIPTION OF THE DRAWINGS

FIG. 1A illustrates, in a side view, closed jaws of a pair of pliers according to an embodiment of the present invention;

FIG. 1B illustrates, in an enlarged view, a front end part of one of the jaws according to this embodiment of the present invention;

FIG. 3A illustrates, in a longitudinally-sectional view, front parts of the pliers pinching a screw according to this embodiment of the present invention;

FIG. 3B illustrates, in an enlarged view, a head of the screw pinched by the jaws depicted in FIG. 3A;

DETAILED DESCRIPTION OF THE DRAWINGS

Figure 2A:
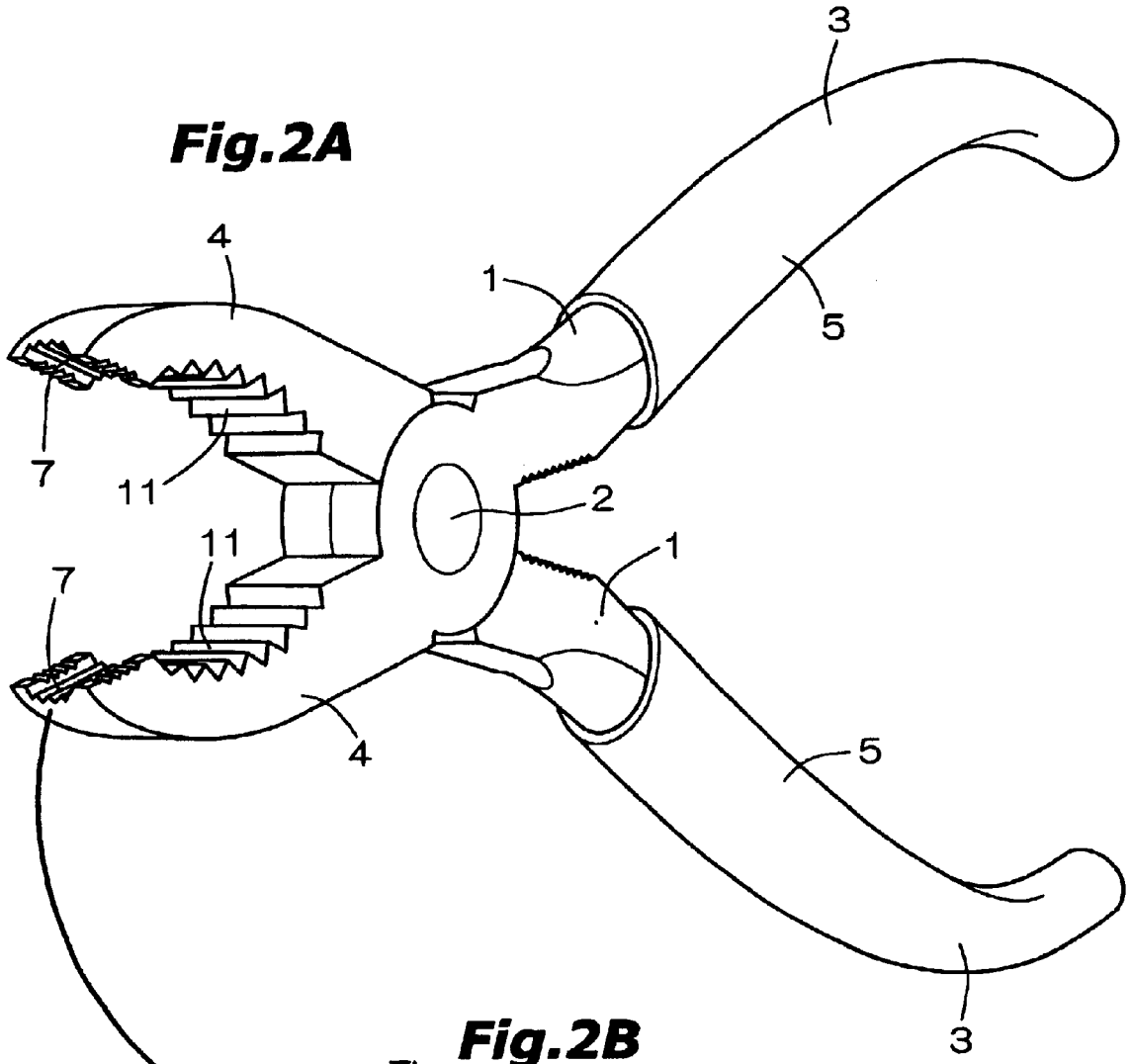
FIG. 2A illustrates, in a perspective view, the pliers according to this embodiment of the present invention.
Figure 2B:
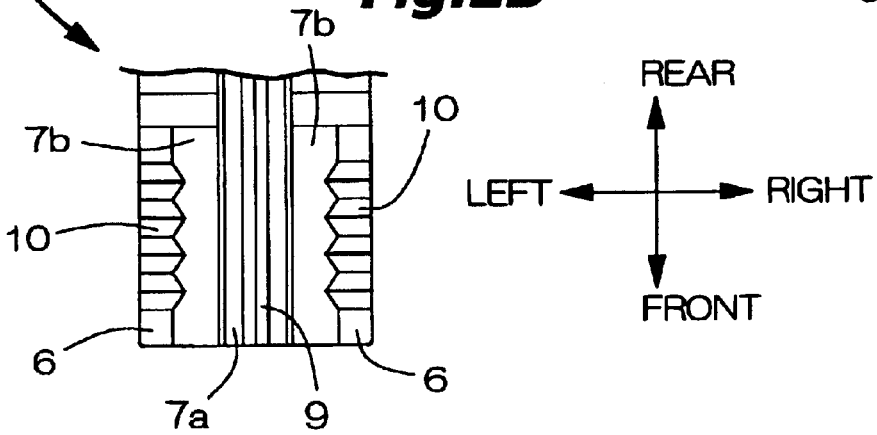
FIG. 2B illustrates, in an enlarged top view, a front end part of the pliers according to this embodiment of the present invention.

FIGS. 1–3 show a pair of pliers in accordance with an embodiment of the present invention. As shown in the figures, the pliers comprise a pair of upper and lower arms 1 which are pivotally supported by shaft 2. Each of arms 1 includes handle 3 behind shaft 2, and jaw 4 ahead of shaft 2. Handle 3 is covered in a plastic cover 5.

As shown in FIG. 2A, front tips of upper and lower jaws 4 respectively have inwardly-recessed engagement parts 7 which vertically face each other between right and left edges 6. Each of upper and lower engagement parts 7 makes a trapeziform shape that comprises inner bottom 7*a* which is substantially flat and, right and left sidewalls 7*b* which are inclined in a manner such that a space therebetween gradually becomes wider outward. Inner bottom 7*a* is provided with a serrate surface having plural projected and depressed streams 9 extending in a back-and-forth direction. More concretely, inner bottom 7*a* is provided with three projected streams each including a sharply-pointed edge.

Each of engagement parts 7 has a predetermined length in a back-and-forth direction. As shown in FIGS. 1A and 1B depicting jaws 4 closing, right and left edges 6 of one of engagement parts 7 and those of another engagement part 7 fit to each other. More precisely, right and left edges 6 of upper and lower engagement parts 7 are butt-contacted by their tips. Right and left edges 6 of upper and lower engagement parts 7 respectively comprise facing serrate surfaces which include plural projected and depressed streams 10 extending in right and left between the front and the rear.

Figure 5:
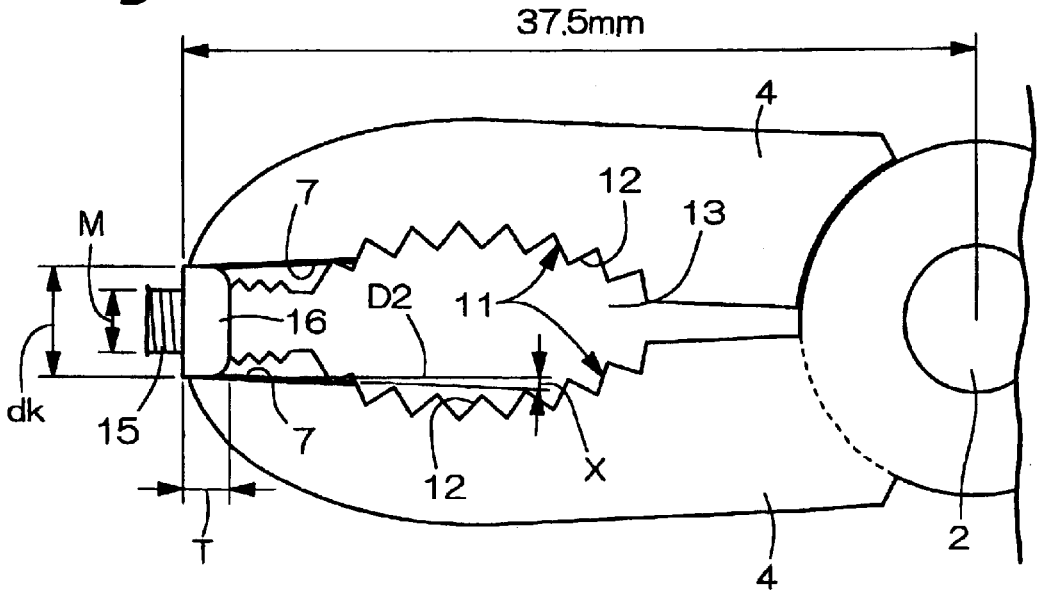
FIG. 5 illustrates, in a side view, front parts pinching a screw according to this embodiment of the present invention.

Each of upper and lower jaws 4 includes a pinching surface 11 which makes an inwardly-recessed shape in the center thereof in a back-and-forth direction. The front end of pinching surface 11 extends from the rear end of engagement part 7. The length of pinching surface 11 is approximately twice longer than that of engagement part 7 in a back-and-forth direction. Pinching surface 11 has a deeper recessed shape than engagement part 7, and includes plural projected and depressed streams 12 extending in right and left between the front and the rear as shown in FIG. 5. In a state shown in FIG. 1A where upper and lower jaws 4 are closed, upper and lower pinching surfaces 11 face and vertically separate from each other, keeping an oval-shaped space 13 that has a longer diameter in a back and forth direction.

In the above-described structure, the pliers of the present invention are characterized by that inner bottoms 7*a* of upper and lower engagement parts 7 become gradually separated vertically from each other toward the rear. At the time, as shown in FIGS. 3A and 3B, when upper and lower engagement parts 7 pinch a head 16 of a screw 15, inner bottoms 7*a* of upper and lower engagement parts 7 face in approximately parallel to each other in response to an outside diameter of the head 16.

Figure 7:
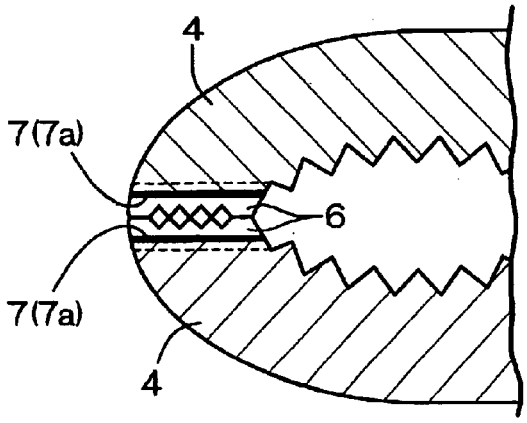
FIG. 7 illustrates, in a longitudinally-sectional side view, closed jaws of a pair of pliers in a comparative example.
Figure 8A:
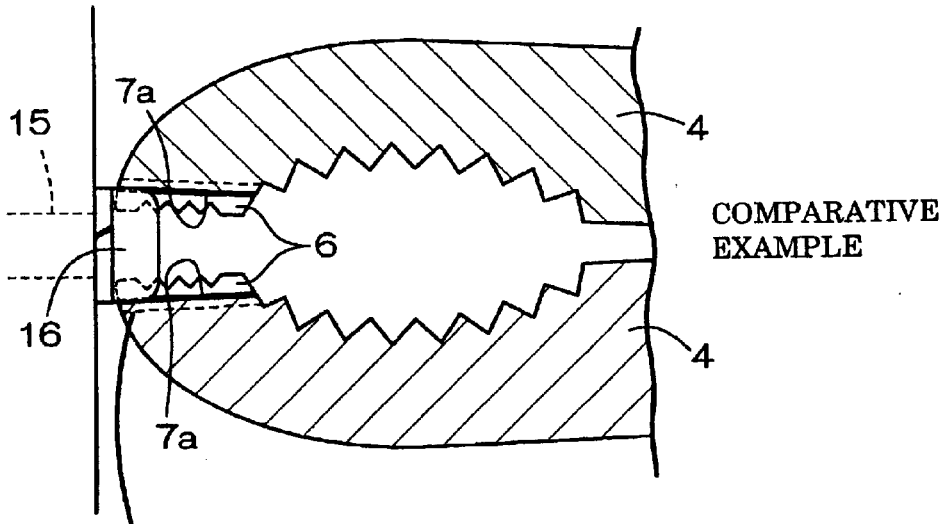
FIG. 8A illustrates, in a longitudinally-sectional side view, front parts of the pliers pinching a screw in the comparative example.
Figure 8B:
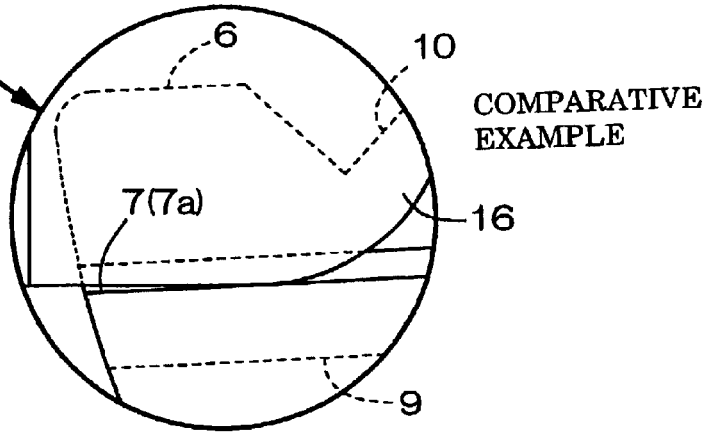
FIG. 8B illustrates, in an enlarged view, a front end of the jaw pinching a head of the screw depicted in FIG. 8A.

FIGS. 7, 8A and 8B show a comparative example. Although the pliers in this example also have a similar structure to the pliers of the above-described present invention, inner bottoms 7*a* of upper and lower engagement parts 7 face parallel to each other when jaws 4 are closed, as shown in FIG. 7. Due to this constitution, when engagement parts 7 pinch a head 16 of a screw 15, upper and lower inner bottoms 7*a* are inclined in a manner such that a space therebetween becomes gradually wider frontward as shown in FIGS. 8A and 8B. Consequently, as shown in FIG. 8B, front ends of inner bottoms 7*a* separate from a circumference of the head 16 thereby decreasing engaging areas between the head 16 and inner bottoms 7*a*. In this state, the pliers cannot hold the screw 15 tightly. Besides, as shown in FIG. 9B, jaw 4 exerts pinching force f1 in an oblique direction thereby producing component force f2, so that reaction force F against component force f2 actuates the entire pliers backward, which may loose jaws 4 on the head 16.

Figure 4:
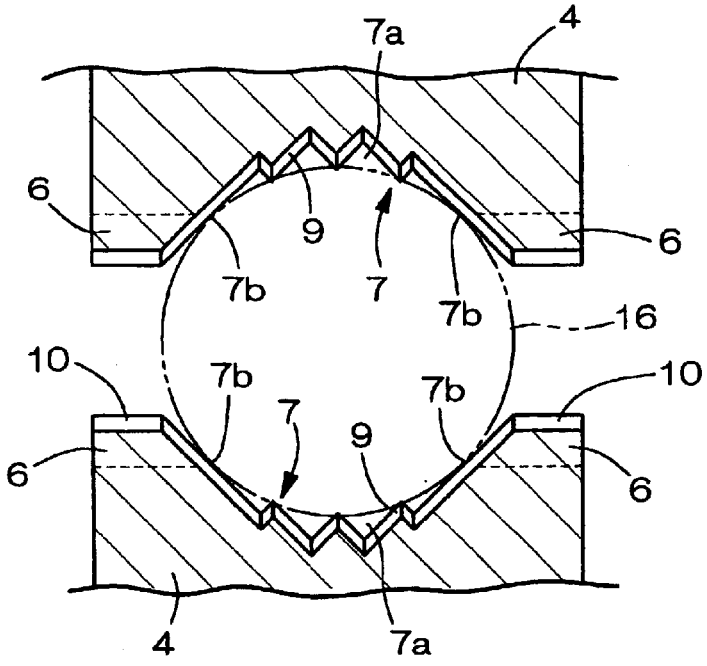
FIG. 4 illustrates, in a longitudinally-sectional front view, front ends of the pliers pinching a screw according to this embodiment of the present invention.

In the present embodiment, as shown in FIGS. 3A, 3B and 4, when engagement parts 7 are open for pinching a head 16 of a screw 15, the pliers tightly hold the head 16 in a manner such that right and left sidewalls 7*b* make line contacts with a circumference of the head 16, and pointed edges of projected streams on inner bottoms 7*a* of engagement parts 7 bite the circumference of the head 16. In this state, bottoms 7*a* of upper and lower engagement parts 7 face in approximately parallel to each other, which prevents front ends of bottoms 7*a* from separating from the head 16 thereby increasing engaging areas between the head 16 and inner bottoms 7*a* compared to the above comparative example shown in FIG. 7, and enhancing the engagement retaining force. Hence, the rotational operating force is exactly transmitted from the pliers to the head 16, so that the pliers can hold the screw 15 tightly.

Figure 9A:
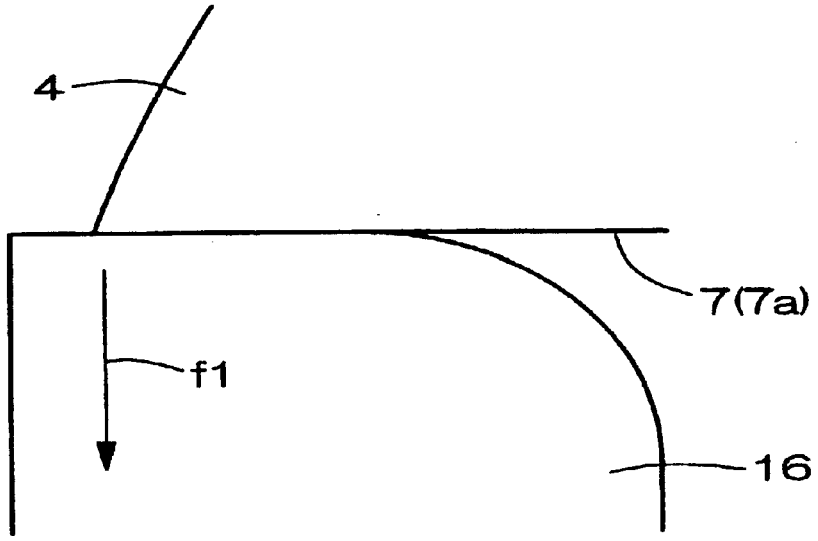
FIG. 9A schematically illustrates, in longitudinally-sectional side view, a front part of the jaw pinching the head according to this embodiment of the present invention.
Figure 9B:
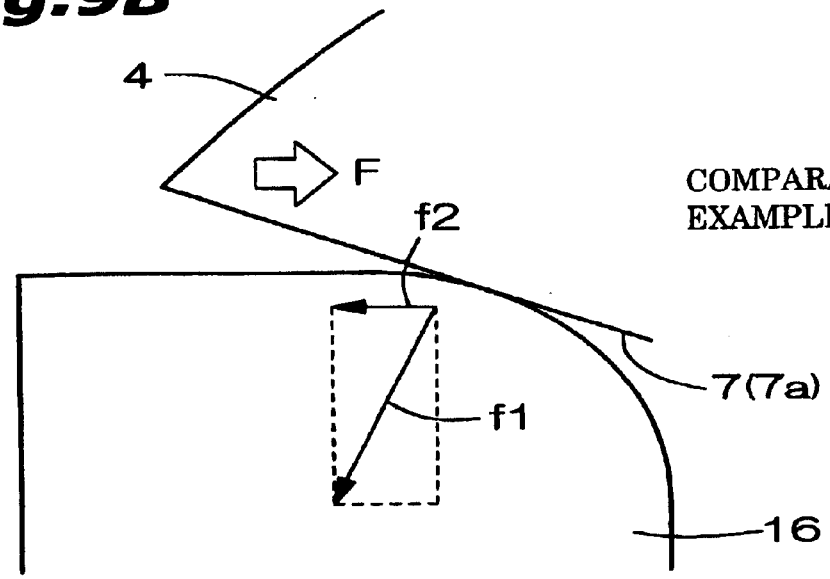
FIG. 9B schematically illustrates, in longitudinally sectional side view, a front part of the jaw pinching the head in the comparative example.
Figure 10A:
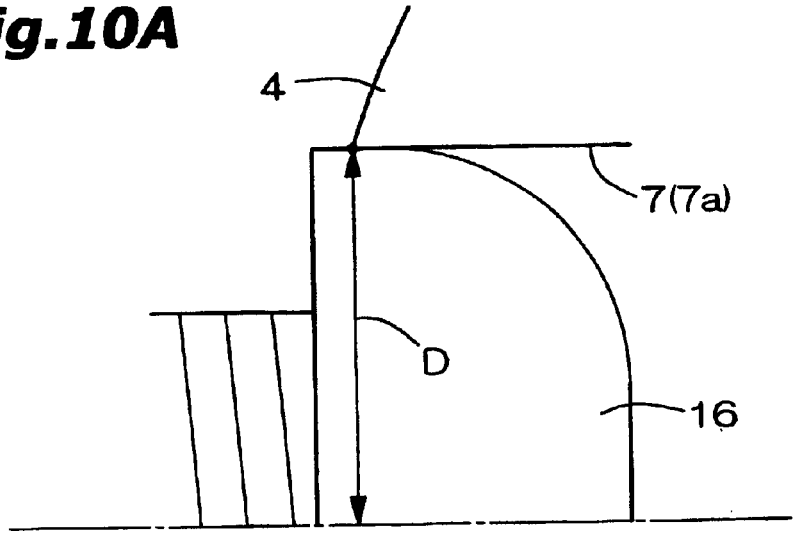
FIG. 10A schematically illustrates, in longitudinally sectional side view, a front part of the jaw pinching the head according to this embodiment of the present invention.
Figure 10B:
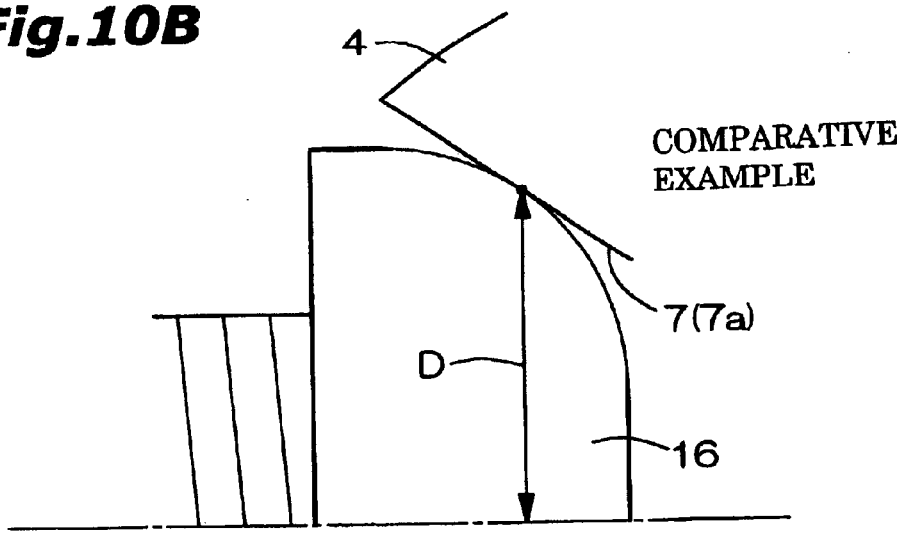
FIG. 10B schematically illustrates, in longitudinally sectional side view, a front part of the jaw pinching the head in the comparative example.

Further, in accordance with the pliers of the present invention, as shown in FIG. 9A, since pinching force f1 is exerted in an approximately vertical direction, component force f2 is not produced. This prevents jaws 4 from separating from the head 16. In addition, as shown in FIG. 10A, this constitution increases a distance D between a center of the screw 15 and a point of action for exerting torque longer than that of the comparative example shown in FIG. 10B, thereby advantageously exerting the larger rotational operating force to the head 16. Using the pliers of the present invention, the user can easily remove a screw a head of which is stripped, a rusted small screw, or even a special small screw known as "tamper-proof screw" which has no handling planes.

Figure 6:
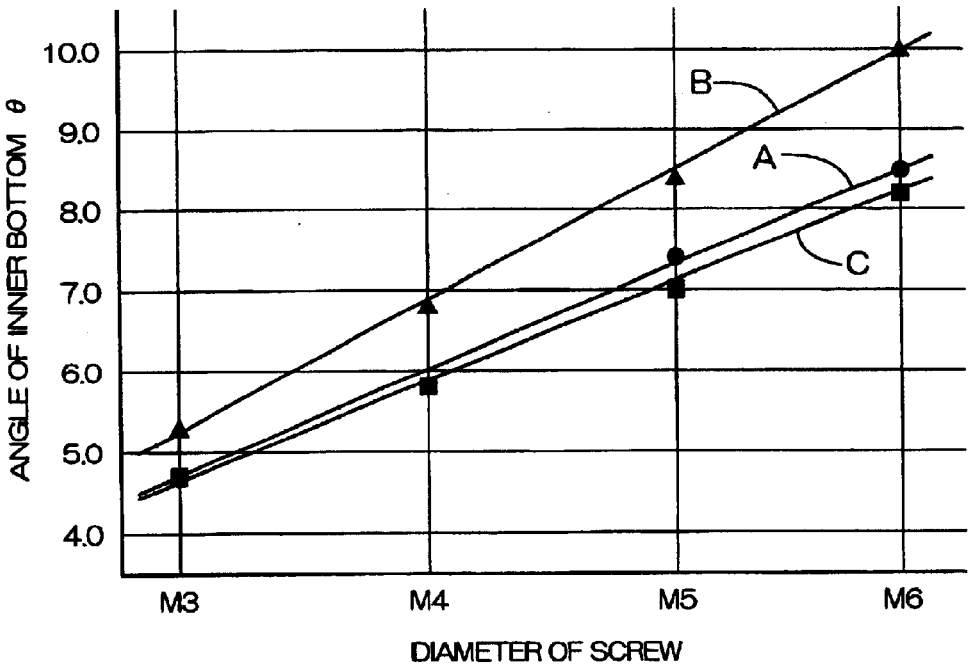
FIG. 6 is a graph of relationships between diameters of screws and angles θ of edges for revolving screws according to this embodiment of the present invention.

In accordance with the present invention, in FIG. 1B showing jaws 4 closing, a preferable angle θ (angle of edge) of inner bottom 7*a* of engagement part 7 against a virtual horizontal line D1 varies according to a type or size of the screw 15. As to three types of screws (small pan head screw A, small bind screw B, hexagon socket bolt C), table 1 shows diameters M3–M6 of the screws, and preferable angles θ for handling these screws, and FIG. 6 shows a graph describing relationships between them. In this embodiment, as shown in FIG. 5, a distance between the center of shaft 2 and the front end of jaws 4 is assumed to be 37.5 mm while an angle X of an ideal relief of inner bottom 7*a* to a virtual horizontal line D2 is assumed to be 2.0 degrees in FIG. 5 showing engagement parts 7 pinching the head 16 of the screw 15. If relief angle X was set larger than 2.0 degrees, the pinching force concentrates into one point, which may damage the head 16 of the screw 15.

TABLE 1

| | Diameter of screw M | Angle of inner bottom ⊖ | Diameter of head dk (mm) | Thickness of head T (mm) | Angle of relief X |
|---|---|---|---|---|---|
| ● | M3 | 4.7° | 5.5 | 2.0 | 2.0° |
| small pan | M4 | 5.8° | 7.0 | 2.6 | |
| head | M5 | 7.4° | 9.0 | 3.3 | |
| screw (A) | M6 | 8.5° | 10.5 | 3.9 | |
| ▲ | M3 | 5.3° | 6.3 | 1.9 | 2.0° |
| small bind | M4 | 6.8° | 8.3 | 2.5 | |
| screw (B) | M5 | 8.4° | 10.3 | 3.1 | |
| | M6 | 10.0° | 12.4 | 3.7 | |
| ■ | M3 | 4.7° | 5.5 | 3.0 | 2.0° |
| hexagon | M4 | 5.8° | 7.0 | 4.0 | |
| socket | M5 | 7.0° | 8.5 | 5.0 | |
| bolt (C) | M6 | 8.2° | 10.0 | 6.0 | |

As shown in FIG. 6, a straight line expressed by a functional equation "θ=1.30M+0.75" indicates ideal angles θ for small pan head screw A, "θ=1.57M+0.56" for small bind screw B, and "θ=1.17M+1.16" for hexagon socket bolt C. It should be known that these equations for expressing straight lines are derived from least-squares method.

As described above, for instance, when an angle θ is set within a range of 10.0° to 8.2° in order to produce pliers for M6, the pliers can mostly handle these three types of screws. Besides, for instance, an angle θ can be determined on a straight line expressed by "θ=1.57M+0.56" in order to produce pliers for bind small screw B.

In the present embodiment, a design can also be adopted such that only a front-end part of inner bottom 7*a* of engagement part 7 is shaped in a serrate surface.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. Pliers, comprising:

a pair of upper and lower arms that are pivotally supported by a shaft;

wherein front end tips of jaws respectively included in said arms are provided with upper and lower recessed engagement parts between right and left edges, and said engagement parts vertically face each other;

wherein each of said upper and lower engagement parts makes a trapeziform shape that comprises an inner bottom, and right and left sidewalls which are inclined in a manner such that a space between said sidewalls becomes wider outward; and wherein said inner bottoms of said upper and lower engagement parts are inclined in a manner such that the engagement parts gradually become separated vertically from each other toward a rear when the jaws are closed.

2. The pliers according to claim 1, said inner bottom of each of engagement parts is provided with plural projected and depressed streams extending in a back and forth direction.

3. The pliers according to claim 2, wherein three projected streams each having a sharply pointed edge are formed on each of said inner bottoms which are substantially flat.

4. The pliers according to claim 2, wherein the right and left edges of one of said engagement parts and those of another engagement part are respectively butt-contacted with each other by tips thereof.

5. The pliers according to claim 3, wherein the right and left edges of one of said engagement parts and those of another engagement part are respectively butt-contacted with each other by tips thereof.

6. The pliers according to claim 1, wherein the right and left edges of said upper and lower engagement parts respectively comprise facing serrate surfaces which include plural projected and depressed streams extending in right and left between the front and the rear.

* * * * *